US007810791B2

(12) United States Patent
DeVos

(10) Patent No.: US 7,810,791 B2
(45) Date of Patent: Oct. 12, 2010

(54) HOIST CONTROLS WITH COMPENSATION FOR DYNAMIC EFFECTS

(76) Inventor: Ryan DeVos, 20049 Coyote Trail, Macomb Township, MI (US) 48043

( * ) Notice: Subject to any disclaimer, the term of this patent is extended or adjusted under 35 U.S.C. 154(b) by 37 days.

(21) Appl. No.: 12/174,303

(22) Filed: Jul. 16, 2008

(65) Prior Publication Data

US 2009/0020492 A1 Jan. 22, 2009

Related U.S. Application Data

(60) Provisional application No. 60/961,075, filed on Jul. 17, 2007.

(51) Int. Cl.
*B66D 1/48* (2006.01)
*B66C 13/40* (2006.01)

(52) U.S. Cl. ..... 254/270; 254/266; 212/285; 414/4

(58) Field of Classification Search ..... 254/270, 254/266, 264, 274, 331, 360, 361, 362; 414/2, 414/4, 5; 212/330, 331, 338, 285
See application file for complete search history.

(56) References Cited

U.S. PATENT DOCUMENTS

| | | | | |
|---|---|---|---|---|
| 4,516,645 | A | 5/1985 | Wetzeli | |
| 5,513,886 | A | 5/1996 | Cyr | |
| 6,241,462 | B1 * | 6/2001 | Wannasuphoprasit et al. | 414/800 |
| 6,386,513 | B1 * | 5/2002 | Kazerooni | 254/270 |
| 6,622,990 | B2 * | 9/2003 | Kazerooni | 254/270 |
| 6,886,812 | B2 * | 5/2005 | Kazerooni | 254/270 |
| 2002/0100899 | A1 * | 8/2002 | Kazerooni | 254/266 |
| 2003/0189197 | A1 * | 10/2003 | Kazerooni | 254/266 |
| 2006/0226106 | A1 | 10/2006 | Zaguroli, Jr. | |
| 2009/0020492 | A1 * | 1/2009 | DeVos | 212/275 |

FOREIGN PATENT DOCUMENTS

| | | |
|---|---|---|
| JP | 06083690 | 11/1994 |
| JP | 2001031369 | 2/2001 |

* cited by examiner

*Primary Examiner*—Evan H Langdon
(74) *Attorney, Agent, or Firm*—John R. Benefiel

(57) ABSTRACT

A servo motor driven hoist includes a float mode in which a load is raised lowered in response to manually applied forces on the load exerted by an operator in which forces applied to the load as a result of accelerations of the load generated by hoist movement of said load are compensated for by sensing the accelerations and computing the forces resulting therefrom, and subtracting those forces from the sensed total magnitude of forces acting on the load to eliminate the effects of dynamically generated forces when in the float mode.

4 Claims, 3 Drawing Sheets

HOIST CONTROLS WITH COMPENSATION FOR DYNAMIC EFFECTS

CROSS REFERENCE TO RELATED APPLICATIONS

This application claims the benefit of U.S. provisional patent application Ser. No. 60/961,075 filed on Jul. 17, 2007.

This application incorporates by reference U.S. published patent application publication no. 2006-0226106 A1 dated Oct. 12, 2006.

BACKGROUND OF THE INVENTION

This invention concerns hoists and more particularly servo motor powered hoists with controls enabling a "float" mode operation as described in U.S. patent application publication no 2006/0226106. In a float mode, the hoist justs balances a load supported on a hoist chain. The load magnitude is sensed by a load cell mounted so as to generate electrical signals corresponding to the magnitude of the supported load. If the operator pushes up or down on the load, this force is sensed by the load cell and the hoist controls operate the hoist so as to move the load up or down correspondingly. This allows an operator to maneuver a load quickly and accurately by direct contact with the load itself.

With heavy loads or systems which are relatively deflectable, servo motor operation will sometimes induce oscillation of the load on the chain when stopped after being driven up or down due to deflections in the hoist structure. These oscillations will create dynamic variations in the force sensed by the load cell caused by the up and down oscillations and hoist operation will also directly create similar dynamic effects on the load cell readings. If the operator is attempting to maneuver the load while the hoist is in float mode at a time when these dynamic effects exist, this distortion of the load cell readings will mask the forces manually exerted by the operator and interfere with attempts to maneuver the load in that way.

It is the object of the present invention to assist maneuvering of a load by operation of a powered hoist in a float mode by eliminating the effects caused by motions of the supported load.

SUMMARY OF INVENTION

The above recited object and other objects which will become apparent upon a reading the following specification and claims are achieved by providing an arrangement for sensing accelerations of the supported load and generating corresponding electrical signals. The forces acting on the load cell due to the dynamic effects of the sensed accelerations are determined as by a hoist control microprocessor and are compensated for in operating the hoist in the float mode. That is, dynamic loadings are in effect disregarded by the hoist controller so that manual maneuvering of the load by the operator is unaffected by these dynamic loading effects on the load cell.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
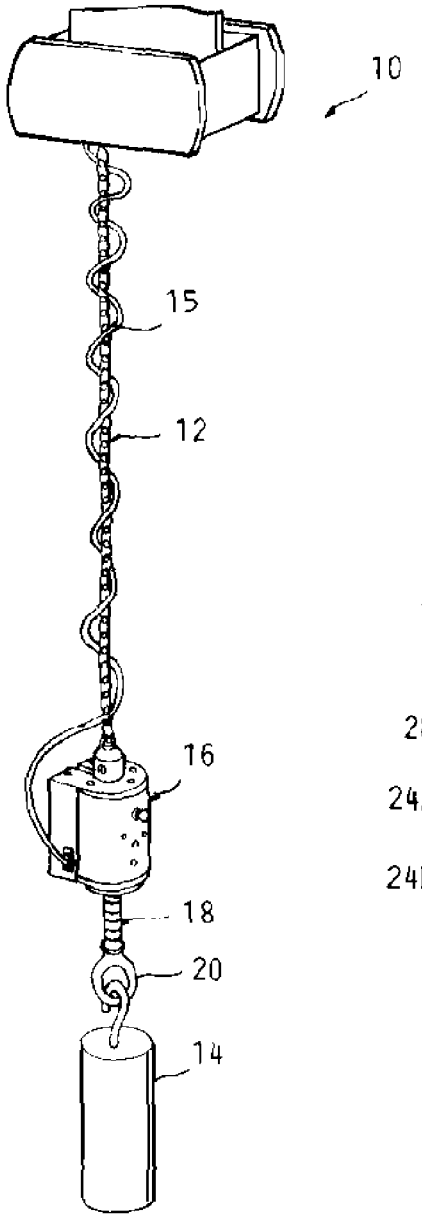
FIG. 1 is a pictorial view of a servo motor powered hoist with an associated hoist chain and supported load together with a controller housing held on the hoist chain.

Referring to the drawings, and particularly FIG. 1, an electric servo motor powered hoist 10 is depicted supported by an over head structure (not shown) such as the over head rails and tractor mechanism described in U.S. 2006/10226106 A1 referenced above.

Figure 2:
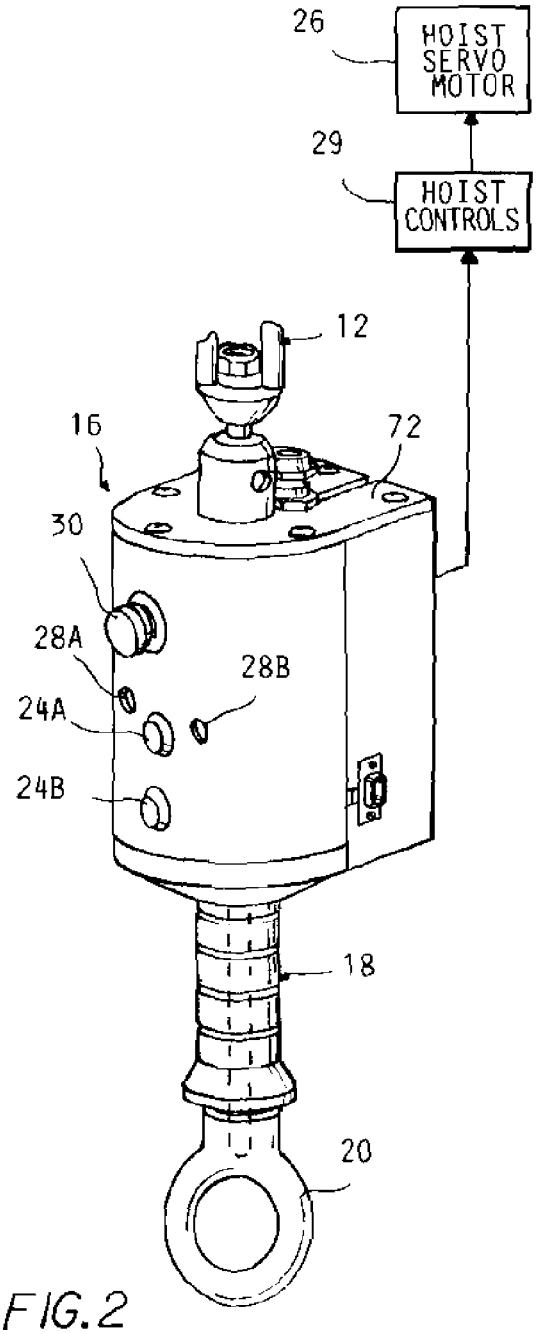
FIG. 2 is an enlarged pictorial view of the hoist controller housing and load support shown in FIG. 1, together with a diagrammatic representation of the hoist controls.

An electric servo motor 26 (FIG. 2) when energized acts on gearing and a wind up hub (not shown) such as described in the referenced patent publication to wind up or pay out the hoist chain 12 to raise or lower a load 14 held on eye 26 supported by the chain 12 below a controller housing 16.

An electrical cable 15 connects the hoist electronic controls 29 (FIG. 2) with a terminal board 17 and other electronic components in the controller housing 14.

The hoist 10 shown may be alternatively be controlled with forces manually applied by an operator using a pendant grip 18 as described in U.S. published application 2006/226106 A1.

Push button switches 24 A, 24B when respectively operated will selectively set a "manual" mode or a "float" mode of operation. In the "float" mode, if an operator manually exerts an up or down force directly on the load 14, the hoist 10 will operate a servo motor to raise or lower the load 14 by sensing the manual force applied and activating the servo motor 26 so as to raise or lower the load 14.

In the "manual" mode, the up or down force is applied to a pendant grip 18 located just below the housing 16 to cause the hoist to operate to raise or lower the load 14.

The buttons 24A, 24B may also be used to preset programmed stops, i.e., operate to raise to a stop position and push the button 26A. Programming will then cause the load 14 to subsequently be automatically stopped at the set position. The load down position can be preset and by depressing button 26B in a similar fashion.

Indicator lights 28A, 28B may provide an indication as to which mode the hoist controls are set.

An emergency stop button 30 can also be provided as a safety measure.

Figure 3:
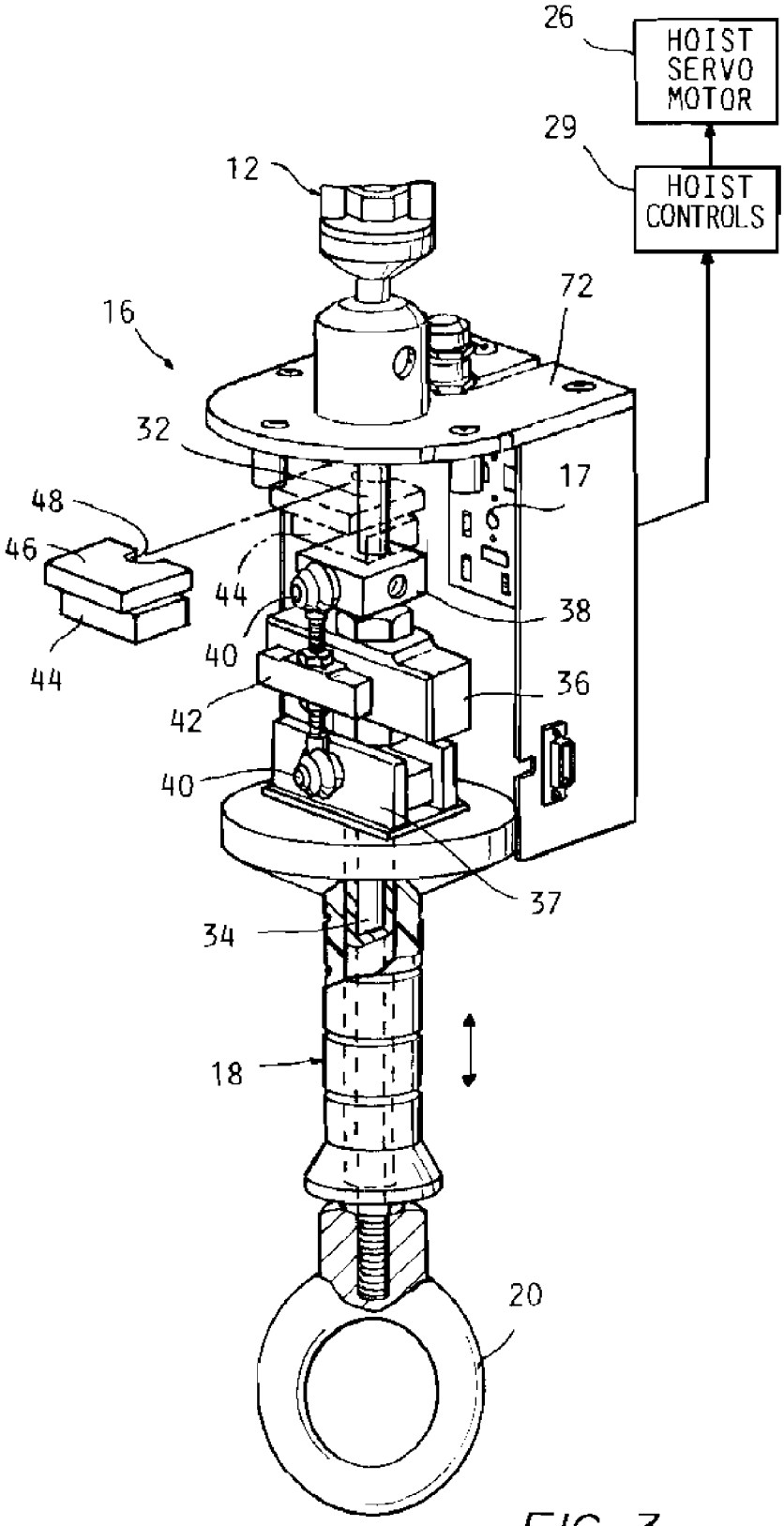
FIG. 3 is a pictorial view of the controller housing with a cover removed to show components contained in the controller housing together with a diagrammatic representation of the hoist motor and controls.
Figure 4:
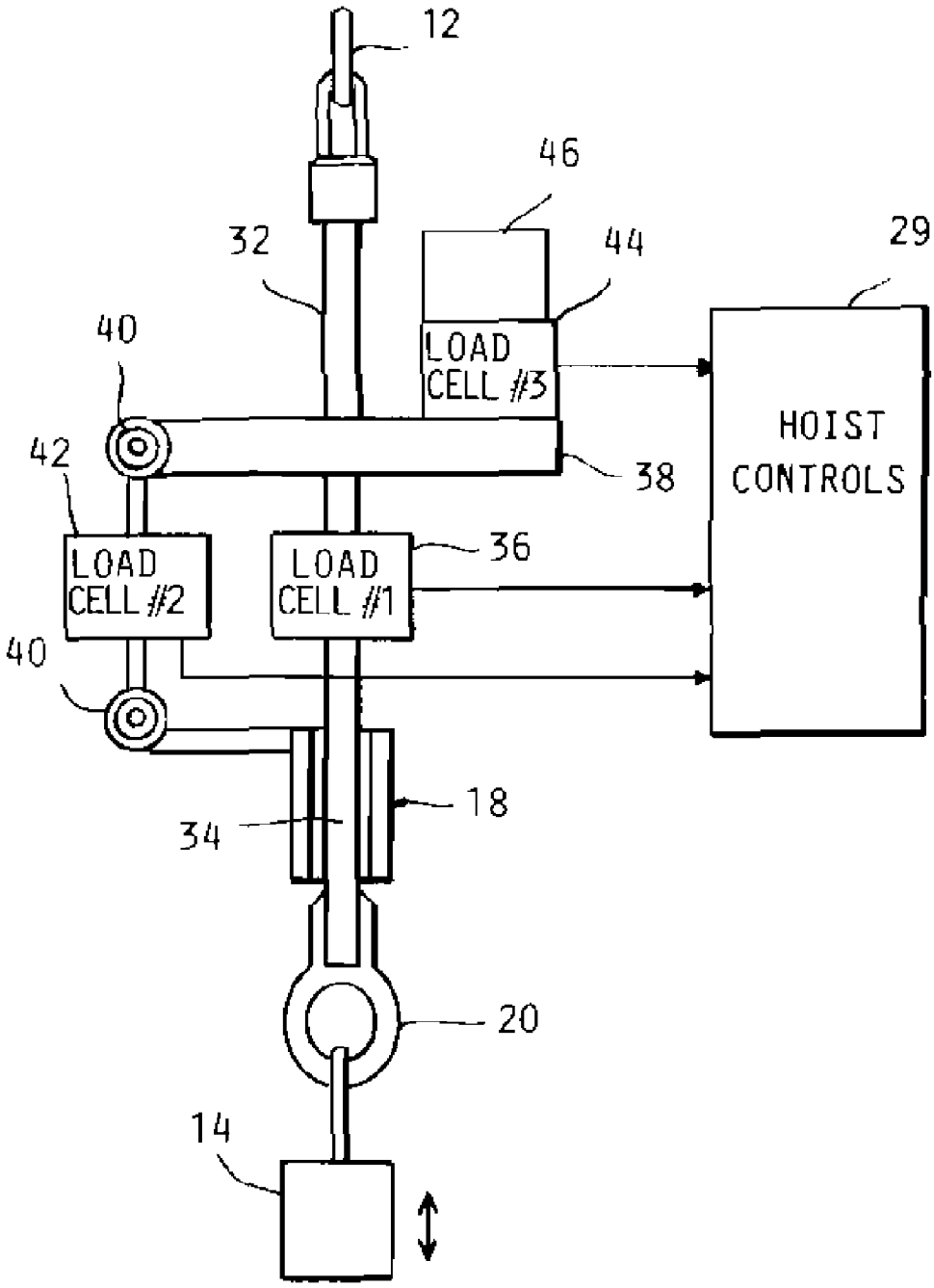
FIG. 4 is a diagrammatic representation of the components associated with the controller housing showing the physical relationship therebetween together with a diagrammatic representation of the hoist controls.

In FIGS. 3 and 4 it can be seen that the chain 12 is connected to an upper shaft 32 which is connected to a lower shaft 34, passing through the grip 18, with a #1 load cell 36 connected via a connector block 37 so as to be able to detect and generate electrical signals corresponding to the weight of the load 14 suspended on the eye 20.

The grip 18 is independently suspended from the upper shaft 32 by a connector block 38 clamped to the upper shaft 32 mounting an upper swivel connector 40A connected to a lower swivel connector 40B attached to the upper end of the grip 18 via a #2 load cell 42.

By this arrangement a force applied to the grip 18 does not affect the magnitude of the load sensed by load cell 36 as described and claimed in the above referenced application.

The present invention is concerned with an improvement in the "float" mode, in which dynamic effects caused by movements of the sensed load 14 are compensated for during float mode positioning of the load 14.

This improvement comprises a sensor arrangement detecting motions of the load 14. The arrangement shown includes a #3 load cell 44 mounted atop the connector block 38 with an inertial mass 46 installed atop the #3 load cell 44 so that any force exerted by the inertial mass 46 will be sensed. The inertial mass 46 is not connected nor contacts the upper shaft 32, the semi circular cutout 48 providing a clearance so that it will develop momentum when accelerated by motion of the load such as when the load 14 continues to oscillate after coming to stop due to deflections in the supporting structure.

This combination constitutes an accelerometer for determining the accelerations of the load induced by operation of the hoist or by any bounce or oscillations of the load 14 induced by the starting and stopping of the load 14.

A conventional or other accelerometer may also be used to sense these motions.

Electrical signals are thus generated corresponding to the accelerations of the load and are transmitted to the hoist controls 29 via a terminal board 31. The forces sensed by the #1 load cell 36 as a result of these accelerations can be computed by a micro processor included in the hoist controls 29 or otherwise determined, and compensated for by adding or subtracting from signal values generated by the load cell 36 so as to compensate for the loadings induced by any motion of the load 14.

Thus even if relatively deflectable support structures are included, accurate control over the movement of the load by the operator exerted forces on the load is maintained.

This is accomplished by a relatively simple arrangement which can be provided at low cost.

The invention claimed is:

1. In combination with a hoist operated by a servo motor raising or lowering support elements supporting a load by a hoist control responsive to a load sensor detecting the total force acting on said support elements, said hoist controls including a float mode in which a load on the hoist is raised or lowered in response to a force manually applied to increase the sensed total force by a hoist operator;

an acceleration sensing arrangement sensing accelerations of said load during hoist operation without being affected by the weight of said load; said sensing arrangement generating signals corresponding to said accelerations, a processor receiving said signals and determining therefrom the magnitude of dynamically generated forces acting on said support elements due to said load accelerations and compensating therefore when in said float mode by subtracting signals corresponding to forces imposed on said support elements solely due to accelerations of said load from signals from said load sensor corresponding to the total force acting on said load to correct for the forces acting on said support elements generated by said load accelerations and thereby determining when forces are manually applied to said load by said operator unobscured by said dynamically generated forces.

2. The hoist according to claim 1 wherein said acceleration sensor arrangement comprises an acceleration detecting load cell carried by said hoist but isolated from said supported load to not be subjected to forces generated by the weight or acceleration of said load and an inertial test mass mounted to said acceleration detecting load cell so as to be accelerated to the same extent as to said load and thereby imposing forces on said acceleration detecting load cell only by said weight and accelerations of said test mass, said processor determining forces generated by said accelerations of said load and thereby distinguishing the forces manually applied to said load by an operator.

3. A method of operating a hoist in a float mode with hoist controls which raises or lowers a load in accordance with the level of forces applied manually by an operator to a load support elements of said hoist, comprising determining accelerations of said load and determining therefrom forces acting on said support elements which are dynamically generated as a result of said accelerations of said load, and compensating for the presence of said dynamically generated forces when responding to a force applied manually to said support elements by an operator by subtracting any dynamically generated forces acting on said support elements from the total force exerted thereon by the weight and accelerations of said load to thereby eliminate the effects in float mode of said dynamically generated forces of obscuring the magnitude of said manually applied forces.

4. The method according to claim 3 wherein said accelerations are sensed by mounting an inertial test mass to said support elements so as to be subjected to the same accelerations as said load but not subjected to the static weight of said load, and supporting said inertial test mass with an acceleration sensing load cell so as to impose forces thereon by said accelerations and generate signals corresponding to said accelerations which are transmitted to said hoist controls to enable the determination of forces acting on said support element by said load in the absence of any acceleration thereof and thereby facilitate determination of said manually applied forces.

* * * * *

UNITED STATES PATENT AND TRADEMARK OFFICE

CERTIFICATE OF CORRECTION

PATENT NO. : 7,810,791 B2
APPLICATION NO. : 12/174303
DATED : October 12, 2010
INVENTOR(S) : Ryan DeVos It is certified that error appears in the above-identified patent and that said Letters Patent is hereby corrected as shown below:

Col. 4, line 18, delete “to”.

Col. 4, line 26, delete “a”.

Signed and Sealed this
Twenty-second Day of March, 2011

David J. Kappos

David J. Kappos
*Director of the United States Patent and Trademark Office*